US005456473A

United States Patent [19]

Whitney

[11] Patent Number: 5,456,473

[45] Date of Patent: Oct. 10, 1995

[54] HIGHWAY CONSTRUCTION BOARD GAME APPARATUS AND METHOD

[76] Inventor: Lyman H. Whitney, 15 G Windsor Ct., Keene, N.H. 03431

[21] Appl. No.: 327,715

[22] Filed: Oct. 24, 1994

[51] Int. Cl.[6] ..... A63F 3/00

[52] U.S. Cl. ..... 273/256

[58] Field of Search ..... 273/256, 276

[56] References Cited

U.S. PATENT DOCUMENTS

| | | | |
|---|---|---|---|
| 4,354,684 | 10/1982 | McKinley | 273/256 |
| 4,480,838 | 11/1984 | Aharonian | 273/256 |
| 4,501,425 | 2/1985 | Alvarado | 273/256 |
| 5,207,792 | 5/1993 | Anderson | 273/256 |

*Primary Examiner*—Benjamin H. Layno

*Attorney, Agent, or Firm*—George W. Dishong

[57] ABSTRACT

A method and apparatus for a board game for two to four players relating to highway construction, the object of which is to be first to complete the sequence of operations of a highway construction project. An inner track on the game board depicts the operations of the construction project which must be completed in sequence by purchasing the necessary equipment for each operation. Completion of an operation earns a monetary draw from the bank and advancement to the next operation. An outer track and a random number selector provide random opportunities to purchase necessary equipment interdispersed with random mandatory supplemental instructions which may benefit or penalize the player. Players may sell or auction off used or surplus equipment. The game may include supplemental educational components.

20 Claims, 9 Drawing Sheets

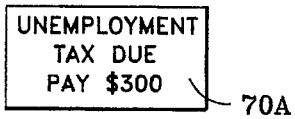
FIG. 3A
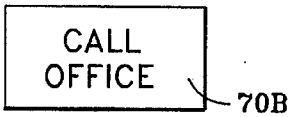
FIG. 3B
FIG. 4
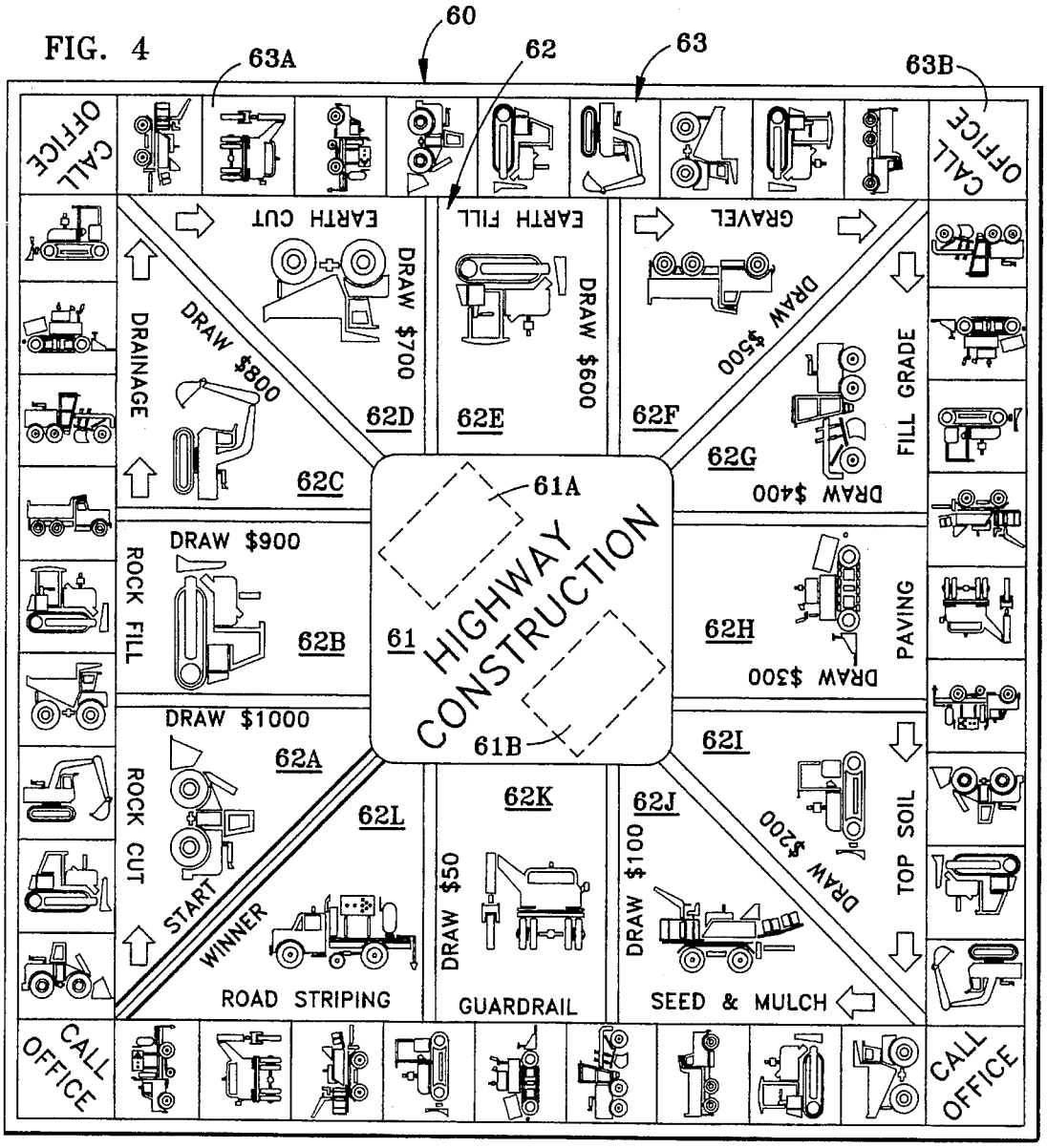

HIGHWAY CONSTRUCTION BOARD GAME APPARATUS AND METHOD

BACKGROUND OF INVENTION

1. Field of the Invention

This invention relates to board games in the conventional format of a game board and accessory set for two or more players, and extends to games played in other formats and mediums including lawn games and interactive, multimedia formats.

More particularly, this invention relates to a highway construction theme whereby the game board layout, components of the accessory set, rules and play of the game correspond to the actual equipment and operations of a highway construction project.

Even more particularly, this invention relates to an educational and entertaining highway construction board game that may include a supplemental educational component in a printed, audio, videotape, interactive multimedia or other format or medium.

2. Description of Prior Art

Games are often models of real-life situations in which the issues are simplified and the participants can become engaged in the action and decision-making without the risks and consequences of the real-life experience. There are virtually countless variations of games in the prior art. The basic elements found alone or in combination in most games include those of physical skill, chance, and strategy. Some common formats include board games, card games, lawn games, word games, children's games, games of fantasy, and electronic or video games.

The art of the present invention includes the elements of chance and strategy in the context of a board game conceived and modeled after a real-life, modern-day highway construction project. It is distinguished from the game of Mancala, or wari, which is a strategic game of the African continent first played in ancient Egypt, with each player having a number of pieces that are distributed about the playing board, where at each move, each player must make estimates involving numerical skill and good judgment in order to capture the opponent's pieces.

The present invention is distinguished from the Asian game of weichi, or go, where the players attempt to surround each other's pieces. It is likewise distinguished from the Indoeuropean game of chess which is characterized as a battle between social orders with the object being to evade or destroy the opposition and check their king.

The present invention is distinguished from the latter-day traditional standard, monopoly, in theme, layout of the board, components of the accessory set, rules, and play of the game, as will be readily seen in the description and claims of the following sections.

The present invention is distinguished from games of geometric construction as illustrated by the art of Levin's U.S. Pat. No. 5,301,953, Apr. 12, 1994, which is a board game including a board having a playing area to be filled with matching and mating pieces to form geometric patterns.

The present invention is also distinguished from highway games such as Scully's U.S. Pat. No. 4,244,143, Jan. 13, 1981, wherein models of vehicles are arranged on moving tracks or belts and physically manipulated by the players via a control system.

The present invention is distinguished from home building board games such as Anderson's U.S. Pat. No. 5,207,792, May 4, 1993, which is a home construction board game of chance and strategy, by differences in the theme, layout of the board, components of the accessory set, rules, and play of the game. Anderson discloses a game the primary object of which is to select a house construction project and obtain building permits, build and furnish the house while making the mortgage payments.

The present invention is likewise distinguished from transportation industry games such as Schultz's U.S. Pat. No. 4,953,872, Sep. 4, 1990, a transportation industry board game of chance and strategy in which players attempt to organize and operate a transportation company to maximize assets.

SUMMARY OF THE INVENTION

The main purpose of this invention is to provide an entertaining and educational board game closely related to the actual sequence of operations of a highway construction project, the prima facia object of which is to be the first player to complete the sequence of operations of the project. Described herein as a board game, the invention might equally well be presented and played in alternate formats such as lawn game or interactive, multimedia formats.

The invention in its simplest form is a board game for two to four people which incorporates the elements of random number selection, equipment buying decisions, management of cash and equipment inventory, anticipation of future cash and equipment needs, risk of random benefits and penalties, evaluation of other players' progress, and interaction with other players, all in the context of conducting the sequential operations of a typical highway construction project. Expanded variations of the game may include provisions for more players or teams of players.

In its simplest form, the operations and their sequence in the game project may be fixed, but in more complex variations of the game, options or choices of the operations and the possible combinations or sequences of operations may be provided, such as the addition of culverts or bridges or intersections. Additionally, optional means of completing given operations may be provided, such as use of dynamite or prison labor or using alternate or extra equipment.

An object of the game is to provide, in addition to a description of the game, the components, the rules and variations of the rules, information and explanations about the actual management and oversight of the operations of a highway construction project and how the game parallels the real thing. Audio or videotapes, or multimedia presentations, for example, might be included.

Another object of the game is to include a stock of play money, a portion of which is allocated to provide all players with initial operating funds that will enable them to start the game; to make initial equipment purchases when they have the opportunity, or to pay unexpected penalties if they land on a "Call Office" mandatory supplemental instruction step. The balance of the stock of money would be allocated to the game's "bank" for the playing of the game. The "bank" activity of this game acts basically as the project financier and equipment supplier, selling and buying back equipment needed to complete the operations, and making partial payments as each player's highway construction project proceeds. The banking activity is administered by any player selected by the other players. The accounting could be done physically with a transfer of paper money and equipment tokens, or by any other means including electronic fund transfer and accounting, and use of equipment models.

Yet another object of the game is to provide distinctive game pieces or symbols for each player to be used to mark the player's progress through the sequence of stops or operations of the project. Players would also have distinctive play pieces or symbols, perhaps color-coded or otherwise corresponding to the game pieces, for marking their position on an opportunity track as they advance based on a randomly selected number at the beginning of each turn.

Still yet another objective of the game is to provide random chances for players to buy the equipment necessary to complete specific operations. To that end, different steps on the opportunity track entitle the player to make specific equipment purchases such as bulldozers, loaders, backhoes, trucks and so on. Purchase or possession of the correct equipment for the player's present operation stop would be deemed as completion of that stop or operation. The player would be entitled to a payment from the bank for a draw amount associated with completing that operation. The player could then dispose of the "used" equipment back to the bank at an appropriately discounted price, in accordance with the details of the rules of the game.

An additional objective of the game is to provide unexpected benefits and penalties in the course of the play, analogous to those of a real highway construction project. To this end, the opportunity track will have mandatory "Call Office" steps interdispersed with the equipment purchasing steps. The random number selected in each turn would occasionally place players on a Call Office step and present a mandatory supplemental instruction that might be either a benefit or a penalty. Such benefits might include state reimbursements for using disadvantaged labor, estimate errors found in the player's favor, profit from extra work, insurance rebate for no accidents, good weather that speeds the work, and so on. Penalties might include OHSA fines, maintenance costs, taxes due, bad weather, insurance costs, and so on. Those familiar with the industry will readily identify dozens of other unplanned benefits and penalties that occur in the course of such a project, and would be consistent with this objective.

BRIEF DESCRIPTION OF DRAWINGS

FIG. 3 illustrates the face side and back side of a typical "CALL OFFICE" supplemental instruction card of the preferred embodiment.

FIG. 4 illustrates the game board of the preferred embodiment, absent the text in the outer track opportunity steps.

DESCRIPTION OF PREFERRED EMBODIMENT

Figure 1A:
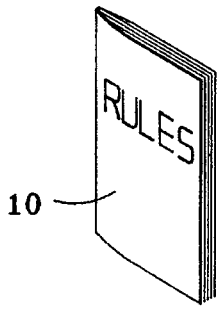
FIGS. 1A–G illustrate the game accessory set of the preferred embodiment consisting of seven components: a rule book, stock of play money, die, a typical game piece depicted as a 4×4 pickup truck in one of four colors, a typical corresponding play piece depicted as a smaller 4×4 pickup truck in the same color, a stock of "CALL OFFICE" supplemental instruction cards, and quantity forty eight (48) equipment tokens.

The invention may be generally described as an entertaining and educational board game for two to four players relating to highway construction, the object of which is to be the first player to complete the sequence of operations of a highway construction project.

The game involves the elements of random number selection, buying decisions, management of cash and equipment inventory, anticipation of future cash and equipment needs, risk of random benefits and penalties, evaluation of other players' progress, and interaction with other players, all in the context of conducting the twelve sequential operations of a typical highway construction project. The first player to complete the sequence of operations of the project is the winner. However, to those skilled in the art the invention admits of many variations.

For example, documentation including rules and instructions may be incorporated which provide for a description of the components, the essence of the game, variations in the manner of playing, explanations as to how the game emulates the actual process of completing a highway construction project, and other relevant, interesting, entertaining or educational information.

As another example, from a stock of play money, an amount of money may be distributed to each player at the beginning of play as initial operating funds, the balance of the money being allocated to the game's bank for the playing of the game. The game's bank may be a financing and equipment supplier activity administered by one of the players. The game requires each player to plan and manage assets in an organized manner in order to participate effectively.

As yet another example, distinctive game pieces for each player may be used in conjunction with the stops on an illustrated first track or inner track of a game board to mark the player's progress through the corresponding sequence of operations of the construction project. Distinctive play pieces, corresponding to but smaller or otherwise distinguishable from their respective game pieces, may be used to move and mark each player's progress along the opportunity steps around a second track or outer track on the perimeter of the board. The game and play pieces may be related to the game's highway construction theme, to specific symbols used elsewhere in the game, or to actual specific highway equipment including the trademarks of the manufacturers.

Each step on the second track may be illustrated or marked to correspond with a piece of highway construction equipment necessary to complete one of the operations or stops on the first track, analogous to the actual equipment needed to complete the corresponding operation of a real highway construction project. The steps of the track may be titled or graphically identified in the following repeating sequence: LOADER, BIG DOZER, BACKHOE, HAUL TRUCK, MEDIUM DOZER, TEN WHEELER, GRADER, PAVER, SMALL DOZER, HYDROSEEDER, POST HAMMER, and STRIPE TRUCK. A player whose play piece lands by chance on a specific step would have the opportunity to purchase one of a limited number of corresponding equipment tokens from the game's bank; possession of a corresponding equipment token being necessary to complete the corresponding stop of the first track of the game. Such equipment tokens may be identified with one of the following titles, a corresponding graphic (shown in the figures) and purchase price: "LOADER $1000, BIG DOZER $1000, BACKHOE $1000, HAUL TRUCK $1000, MEDIUM DOZER $750, TEN WHEELER $750, GRADER $750, PAVER $750, SMALL DOZER $500, HYDROSEEDER $500, POST HAMMER $500, STRIPE TRUCK $500."

A player who has completed all of the previous stops, and who has or obtains possession of the correct equipment token for the current stop, is deemed to have completed the current stop. Upon completion of a stop, the player earns from the bank the monetary "draw" amount associated with finishing that operation, again analogous to the actual partial payments commonly given by the contracting or financing authority to highway contractors as they finish portions of an actual project. Surplus or used equipment tokens may be auctioned off or sold back to the bank at a reduced price, again analogous to actual business practice.

As yet still another example, the opportunity steps of the second or outer track may be interdispersed with mandatory steps which may be called "CALL OFFICE" steps and which require a player whose play piece has by chance landed thereon to select and comply with the next available individual supplemental instruction from a randomly arranged collection of supplemental instruction cards placed face down on a spot in the central portion of the game board. The supplemental instructions may provide an immediate or future benefit or penalty to the instructed player and to the other players as well, which may affect the outcome of the game. The close analogy of this injection of unforseen circumstances into the game, as to the operation of an actual highway construction project, will be readily apparent to those skilled in the art of highway construction.

As an additional example, the game will include a random number selection device such as a die, a pair of dice, a spinner, or other known means of random number selection by which the players may in turn determine the number of steps to advance their play piece on the second track. The starting point and resulting number would determine whether the player lands on a mandatory step which would require the player to accept the next available supplemental instruction, or whether the player lands on an opportunity step which provides an opportunity to purchase a corresponding equipment token from the bank if the player has enough money and chooses to do so.

As another additional example, the stops on the first track corresponding to the operations of the game's construction project, as well as other game components, may be graphically or textually labelled or identified or illustrated as any of the set of operations including: ROCK CUT, ROCK FILL, DRAINAGE, EARTH CUT, EARTH FILL, GRAVEL, FINE GRADE, PAVING, TOPSOIL, SEED & MULCH, GUARDRAIL, and ROAD STRIPING. Alternatively or in combination, the stops or operations may be graphically or textually labelled or identified as any of the corresponding set of equipments including: LOADER, BIG DOZER, BACKHOE, HAUL TRUCK, MEDIUM DOZER, TEN WHEELER, GRADER, PAVER, SMALL DOZER, HYDROSEEDER, POST HAMMER, and STRIPE TRUCK.

The operations and equipments are listed roughly in the actual sequence of a real highway construction project; therefore these lists or any similar lists are very relevant to the organization and labeling of operations or stops on the first track of the game. Two or three dimensional generic graphic symbols, or photographic reproductions or replicas of actual highway construction industry equipments, may be used as the representative or designating identifiers of the operations of the game's highway construction project and other corresponding components of the game. Other components that may be similarly identified or depicted include but are not limited to opportunity steps, equipment tokens, game and play pieces, "CALL OFFICE" cards, the game board, random number selectors and documents.

As yet another additional example, the "CALL OFFICE" cards may have any of the following, and more or similar, individual instructions:

"State Reimbursement for Flagmen—Get $200; Estimate Error— Get $500; No Rain for Weeks—Cost Savings—Get $500; Rebate from Suppliers for Prompt Payment—Get $200; Extra Work— Collect $250 from Each Player; Go to Next Equipment Card Space You Need to Continue Completion of Operations; Insurance Rebate—No Major Accident Last Year—Get $300; Won OSHA Court Case—Get $500; Free Demonstrator #5 MEDIUM DOZER; Free Demonstrator #9 SMALL DOZER; Found GRAVEL on Site—Get $1000; Written Safety Program Card—Keep this Card for Duration of Game—Good for 25% Reduction of All OSHA Fines; Emergency Service—Flat Tire—Pay highest Amount of Equipment Owned—LOADER $250—HAUL TRUCK $200; GRADER $150; TEN WHEELER $100; Free Maintenance—Redeem this Card for Free Scheduled Equipment Maintenance; Replace Cutting Edge on GRADER Blade—Pay $200; Free Flat Tire Service—Redeem This Card for Free Tire Service; Found Cheaper Subcontractor—Get $300; OSHA Violation—Gas Cans Not Labeled with Hazard Tags—Pay $400; Record Week—Get $500; Unemployment Tax Due—Pay $300; OSHA Violation—Workmen in Trench Without Shoring Protection—Pay $800; Accident—HAUL TRUCK Rolled Over Trying to Avoid a Woodchuck in Haul Road (Driver Unhurt)—Repairs—Pay $250; Income Tax Due—Pay $500; Liability Insurance Premium Due—Pay $500; Rain—Lost Day—Pay $300; Workmen's Compensation Tax Due—Pay $300."

These and additional, similar supplemental instructions providing random, unexpected benefits or penalties will be known to anyone skilled in the art of highway construction to be clearly relevant to the theme of the game.

As still yet another additional example, the game may include additional and supplemental educational and entertainment materials and compenents related to the theme of the game in printed or videotape or other mediums.

Figure 1B:
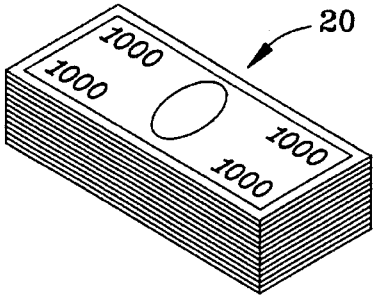
Figure 1C:
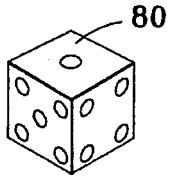
Figure 1D:
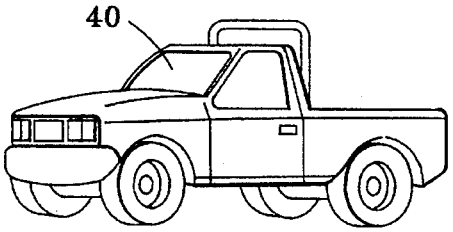
Figure 1E:
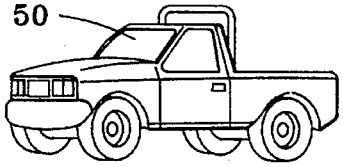
Figure 1F:
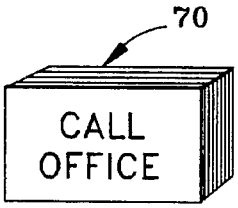
Figure 1G:
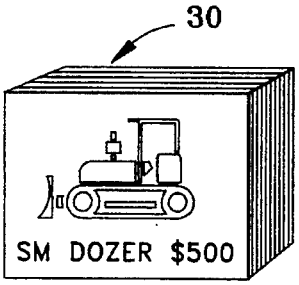
Figure 2A:
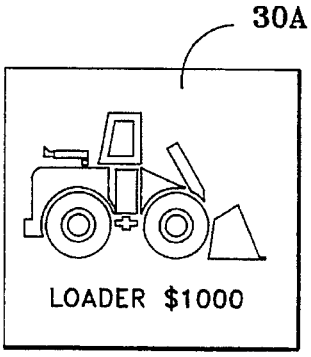
FIG. 2 illustrates the set of twelve different equipment tokens of the preferred embodiment, of which there are four of each, and the reverse side of one token showing relative buy-back and bid prices.
Figure 2B:
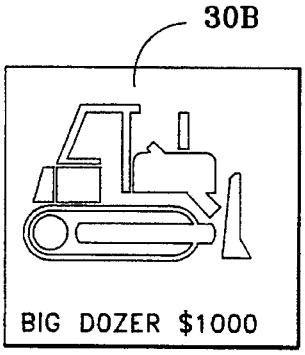
Figure 2C:
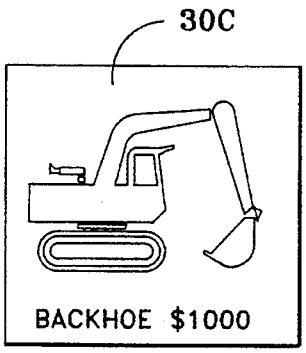
Figure 2D:
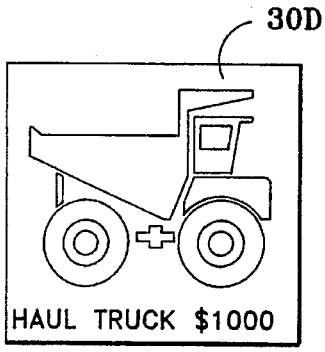
Figure 2E:
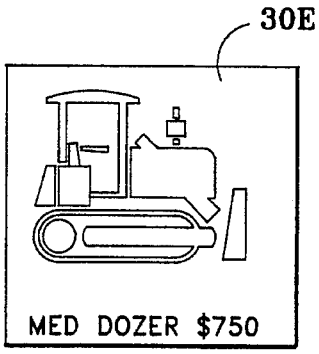
Figure 2F:
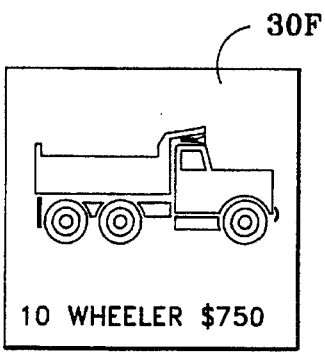
Figure 2G:
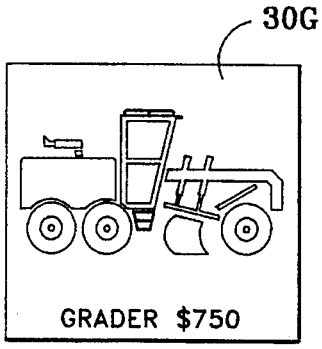
Figure 2H:
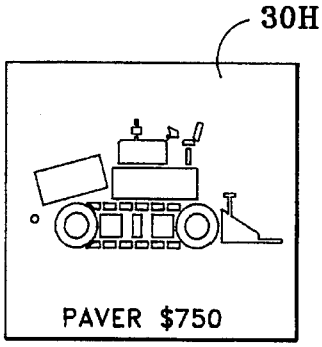
Figure 2I:
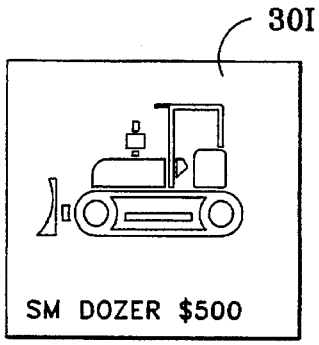
Figure 2J:
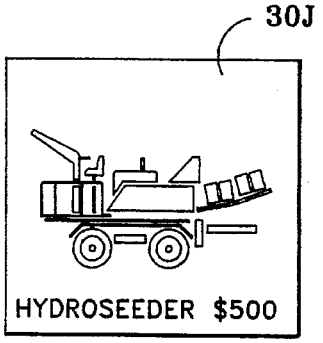
Figure 2K:
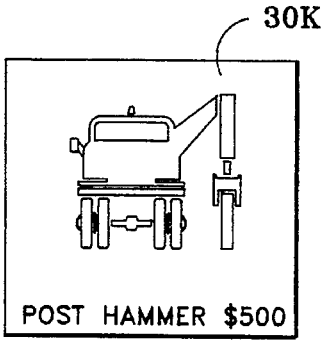
Figure 2L:
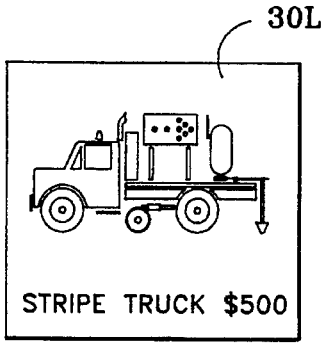
Figure 2M:
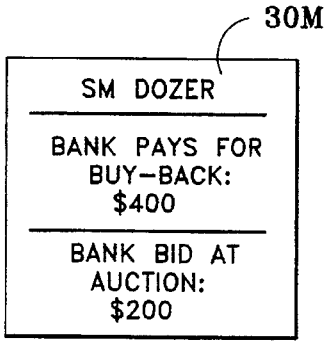
Figure 5A:
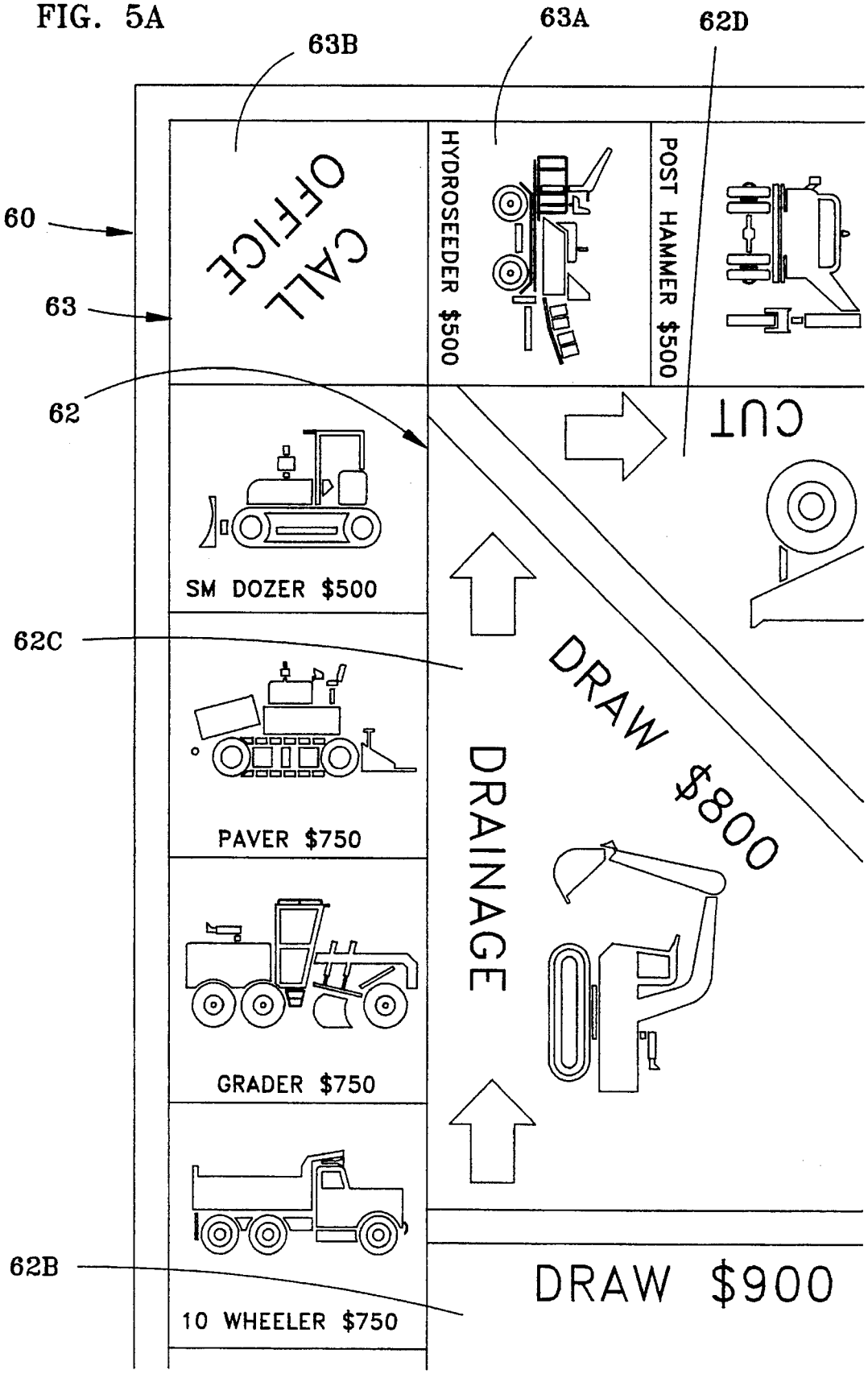
FIGS. 5A–F illustrate the detail of the outer track opportunity steps of the game board in relation to the whole, in six partial view drawings.
Figure 5B:
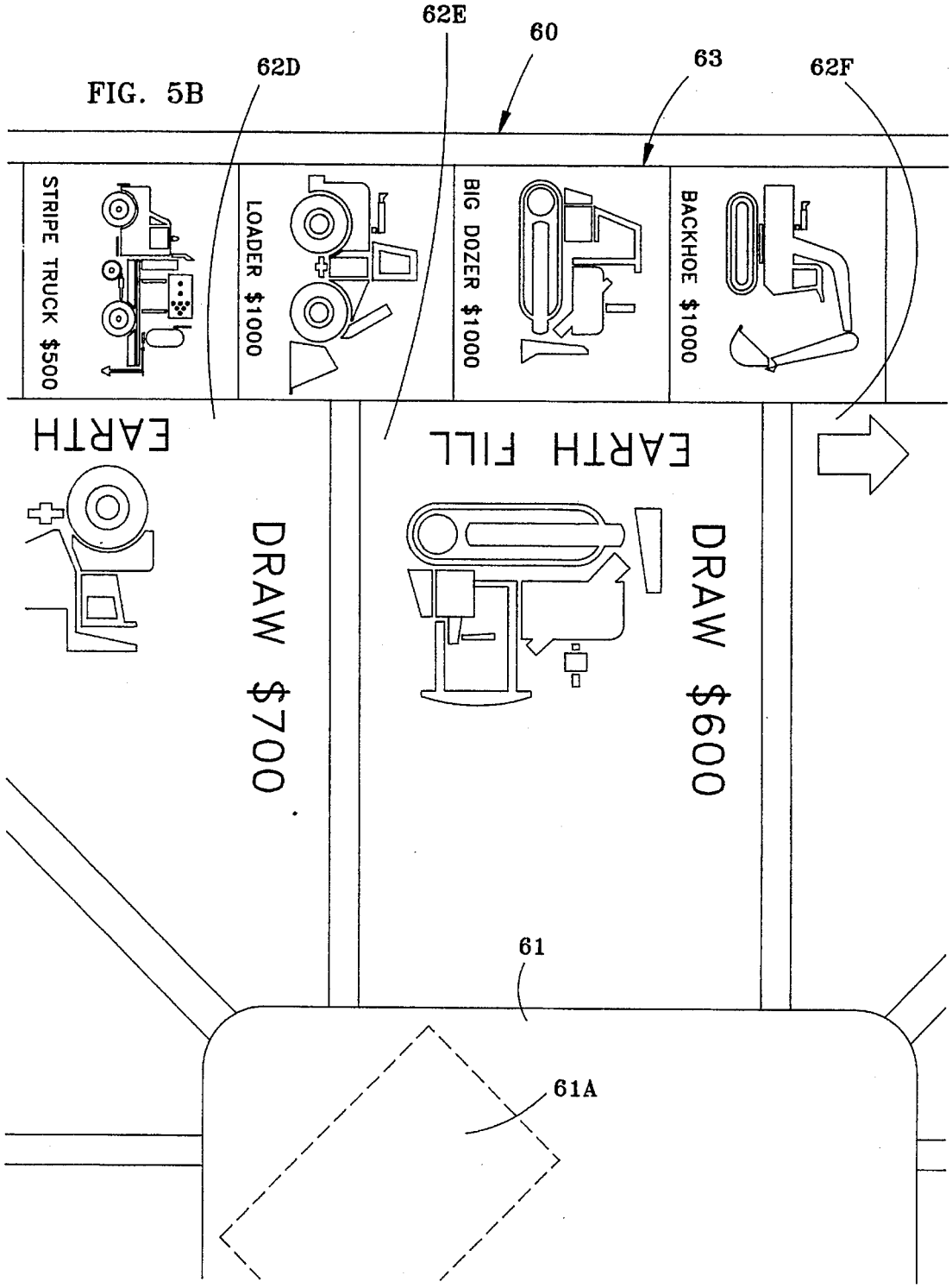
Figure 5C:
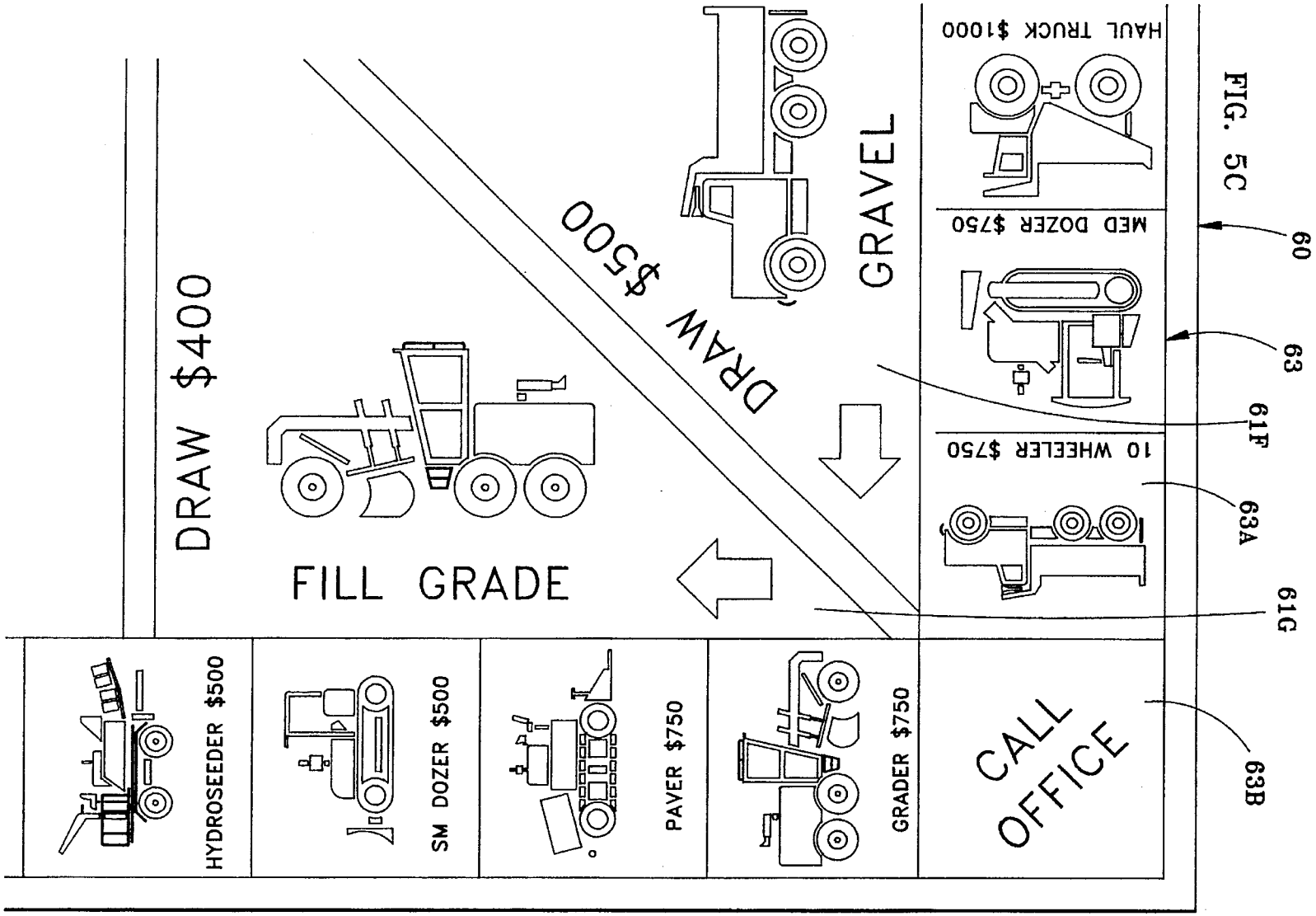
Figure 5D:
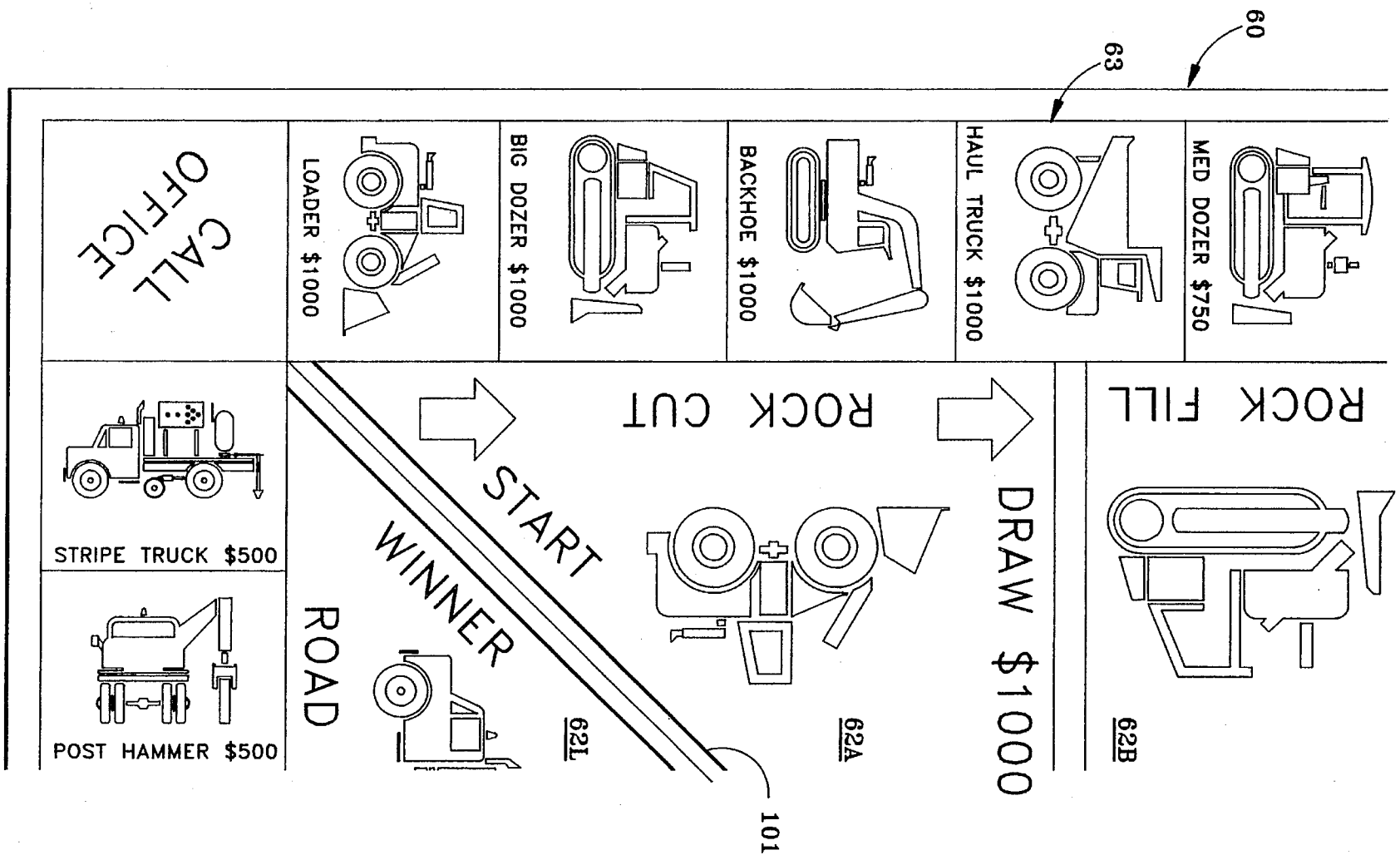
Figure 5E:
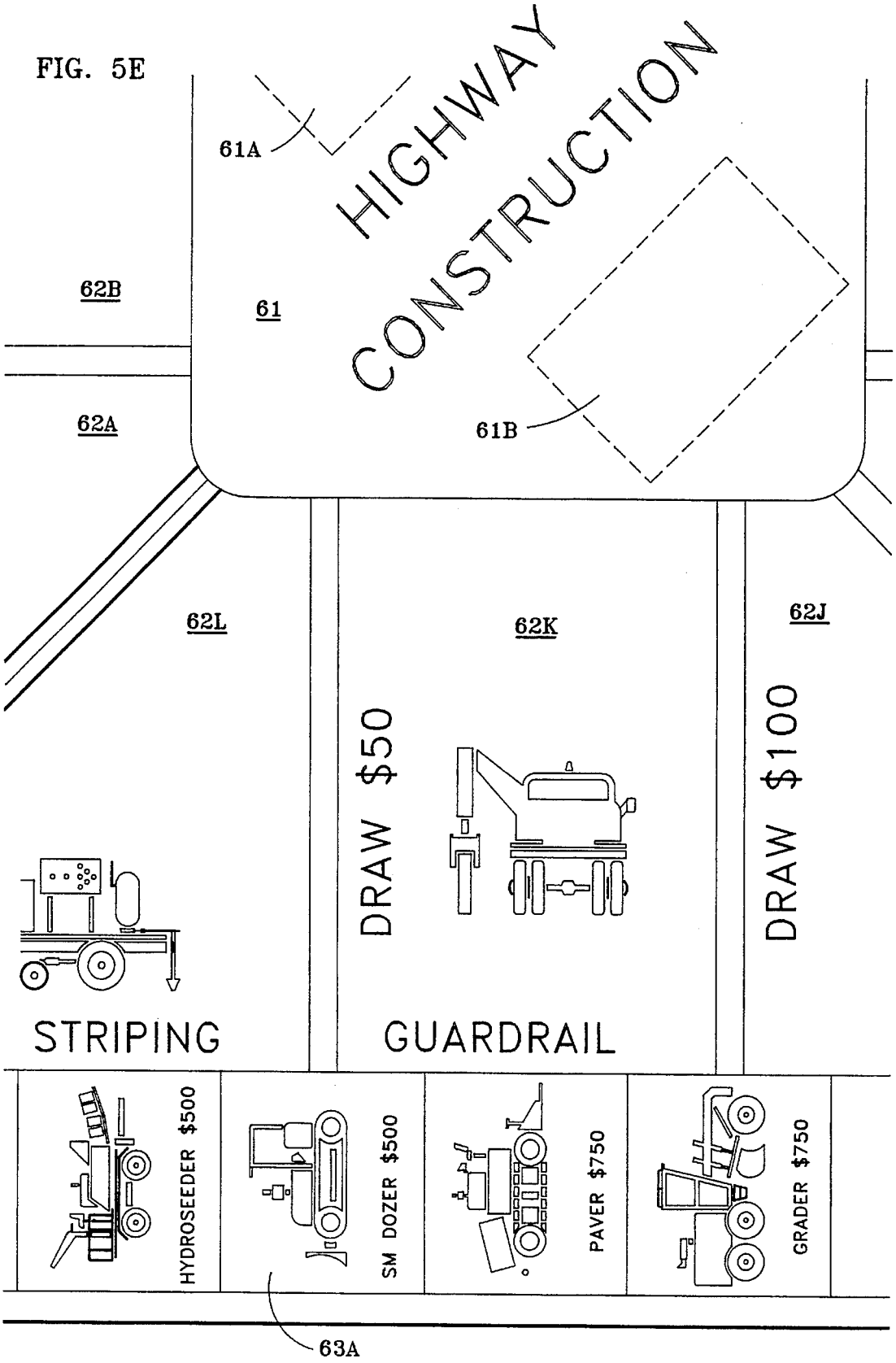
Figure 5F:
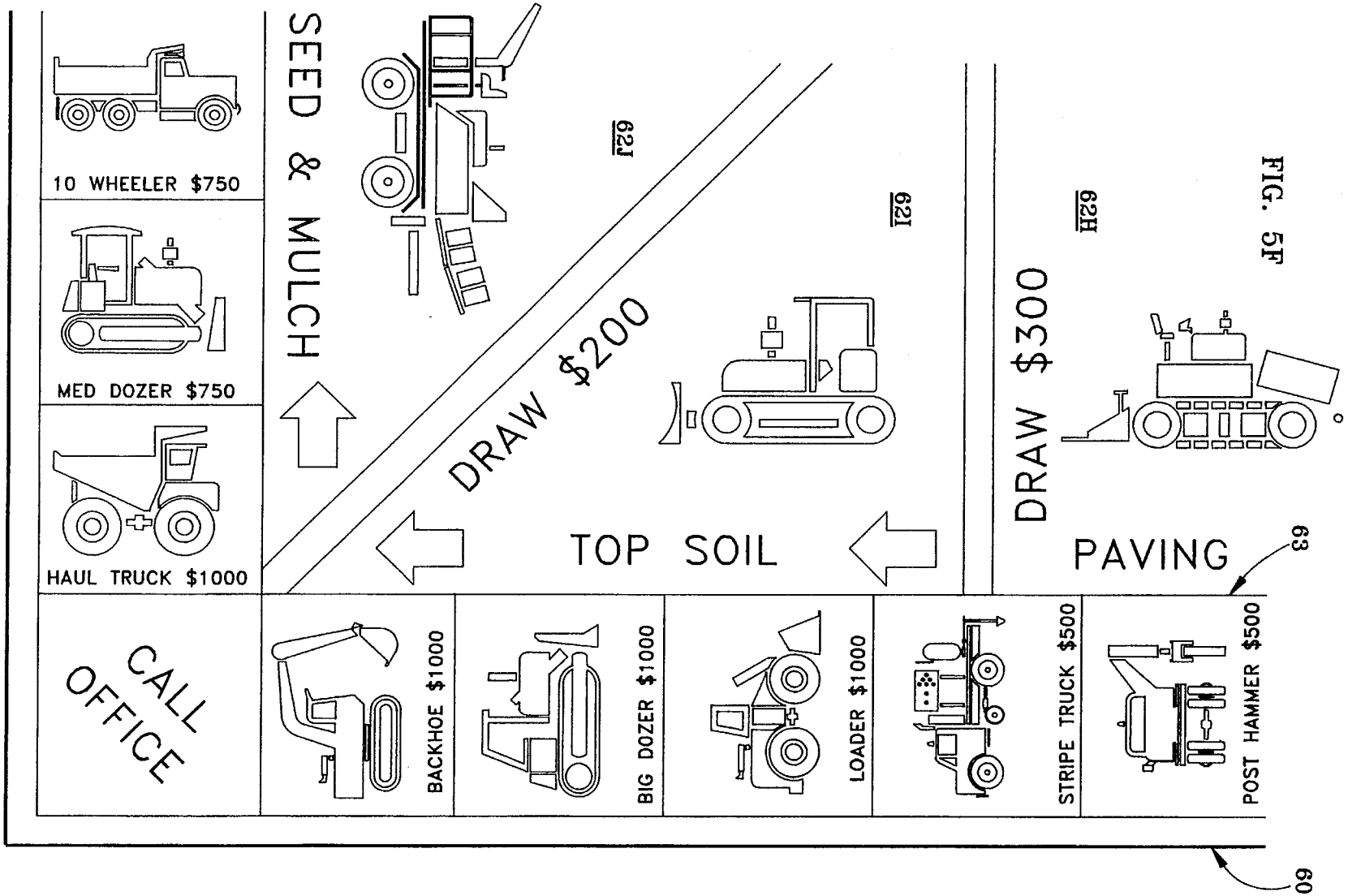

Referring now to FIGS. 1–5 which illustrate pictorially the various components of the preferred embodiment, the components and the playing of the preferred embodiment of the game are herein described:

In accordance with rules 10, the amount of $2500 is distributed to each of two to four players from a stock of play money 20, the balance being allocated to the game's "bank", which is simply an accounting function administered by one of the players.

The bank initially has ownership and possession of a quantity of forty eight (48) equipment tokens 30 comprised of four each of tokens 30A-L, tokens 30A-L being respectively titled and having a corresponding graphic (shown in the figures) and purchase price: LOADER $1000, BIG DOZER $1000, BACKHOE $1000, HAUL TRUCK $1000, MEDIUM DOZER $750, TEN WHEELER $750, GRADER $750, PAVER $750, SMALL DOZER $500, HYDROSEEDER $500, POST HAMMER $500, STRIPE TRUCK $500.

Each player selects a game piece 40, and a corresponding play piece 50.

Four-sided game board 60 has a four-sided center portion 61 within which are located at two opposite corners, rectangles 61A and 61B. Starting at a corner of center portion 61 and running clockwise around and adjacent to center portion 61 is a first track 62 made up of twelve sequential stops 62A-L, representing the sequence of twelve operations of the highway construction project. Stops 62A-L are respectively titled and have a corresponding graphic (shown in the figures), and monetary "draw" allowance in dollars for completion of the stop: ROCK CUT (LOADER graphic) $1000, ROCK FILL (BIG DOZER graphic) $900, DRAINAGE (BACKHOE graphic) $800, EARTH CUT (HAUL TRUCK graphic) $700, EARTH FILL (MEDIUM DOZER graphic) $600, GRAVEL (TEN WHEELER graphic) $500, FINE GRADE (GRADER graphic) $400, PAVING (PAVER graphic) $300, TOPSOIL (SMALL DOZER graphic) $200, SEED & MULCH (HYDROSEEDER graphic) $100, GUARDRAIL (POST HAMMER graphic) $50, ROAD STRIPING (STRIPE TRUCK graphic) Winner.

Starting at the corresponding corner of board 60 and running clockwise around the perimeter of board 60 is a second track 63 made up of quantity thirty six (36) opportunity steps 63A (typical) and quantity four (4) mandatory steps 63B (typical). The mandatory steps 63B are titled: CALL OFFICE. A mandatory step 63B is located on each of the four corners of board 60; equally interdispersed with opportunity steps 63A. Beginning at winner/start line 101, opportunity steps 63A are titled in the following sequence with the following name, a corresponding graphic (shown in the figures), and a purchase price for a corresponding equipment token 30: LOADER $1000, BIG DOZER $1000, BACKHOE $1000, HAUL TRUCK $1000, MEDIUM DOZER $750, TEN WHEELER $750, GRADER $750, PAVER $750, SMALL DOZER $500, HYDROSEEDER $500, POST HAMMER $500, STRIPE TRUCK $500. The identification sequence is repeated three times to cover the full set of quantity thirty six (36) opportunity steps 63A of second track 63.

A collection of individual supplemental instruction cards 70, called "CALL OFFICE" cards, is shuffled to assure random order, divided into two parts or decks and each deck is placed face 70A down on squares 61A and B, with "CALL OFFICE" side 70B showing.

Each player's game piece 40 is placed on first stop 62A of first track 62. Players may roll die 80 or use other common means to determine which player goes first. The fundamental moves and rules for playing the game follow:

Players, in turn, roll die 80 or use some other random number selector and move respective play piece 50 clockwise, beginning on their first turn at the start of second track 63 and continuing forward clockwise at each successive turn until the game is finished, the number of steps determined by the roll. If play piece 50 lands on an opportunity step 63A, player has immediate option to purchase a respective equipment token 30 from the bank at the specified price, if one is available and if the player has the money. If purchased equipment token 30 corresponds to the stop 62 currently occupied by player's game piece 40, player is said to have completed that operation of the project. Player is then paid by the bank the monetary draw amount indicated and advances game piece 40 to the next stop 62.

If play piece 50 lands on a "CALL OFFICE" mandatory step 63B, player selects the top "CALL OFFICE" card 70 from player's choice of squares 61A or 61B, and follows the supplemental instructions thereon.

Bank may buy-back used tokens 30 if the player's play piece lands on a subsequent, corresponding opportunity step 63A, or bid at auction for surplus tokens 30, in accordance with the instructions on the back side of each token 30 as illustrated by typical back side 30M.

The first player to complete the sequence of twelve consecutive stops of track 62, representing the twelve operations of a highway construction project, is the winner of the game.

To those skilled in the art of games and of highway construction, it will be readily apparent that there are many variations of the details of the components and the playing of the game that fall within the scope of the invention as disclosed and claimed.

I claim:

1. A game to be used by at least two players, relating to highway construction, the object of which is to be first to complete a sequence of operations of a highway construction project, said game comprising:

a specified amount of play money, an equal portion of which is distributed as initial operating funds to each player at beginning of said game, remainder of which is allocated to a bank with which each player carries out transactions during said game, said bank being a game-related financing and equipment supplier activity administered by a designated one of said players;

a random number selection device for use, in turn, by each said player, said random number selected mandating an action by said player using said selection device, of moving a distinctive play piece selected by said player at beginning of said game;

a game playing surface comprising; a first track having a series of stops representing said sequence of operations of a highway construction project and a second track upon which said play piece is moved based on said random number selected and having a multiplicity of opportunity steps, said opportunity steps of said second track being interdispersed with at least one mandatory step;

a collection of randomly arranged individual supplemental instructions, a next available one of said supplemental instructions which is accessed and executed by each said player when said play piece of said player lands on any said mandatory step, said supplemental instructions being randomly advantageous and disadvantageous for said player;

a distinctive game piece for each said player, said game piece being advanced along said second track in function of said numbers generated by said number selection device and said opportunity steps upon which said play piece lands, each said opportunity step providing an option for said player landing thereon to purchase, from said bank, from a set of equipment tokens a corresponding one of said tokens, each of said tokens representing a piece of specific highway construction equipment necessary to complete a specific said stop of said series of stops on said first track, and each said stop having a monetary draw amount associated with completing said stop, completion of any said stop requiring sequential completion of all preceding stops and current possession of one of said tokens corresponding to said stop, said player upon said completion earning payment of said monetary draw amount from said bank and advancement of said game piece to next said stop;

each of said tokens being resalable, after use, to said bank at a repurchase price less than said purchase price, and each of unused said tokens being transferable for value between said players.

2. The game of claim 1, said first track being configured as an inner track around a center portion of a game board, said second track being configured as an outer track around perimeter of said game board.

3. The game of claim 2, said first track comprising quantity twelve (12) said stops, said second track of said board comprising quantity thirty six (36) said opportunity steps equally interdispersed with quantity four (4) said mandatory steps, said set of equipment tokens comprising quantity four (4) each of quantity twelve (12) different said tokens.

4. The game of claim 3, said collection of randomly arranged supplemental instructions comprising each of said supplemental instructions printed on a face of a card, wherein at least one of said supplemental instructions imposes a financial penalty on said player and another at least one other of said supplemental instructions imposes a financial benefit on said player, said cards being shufflable and divisible into two decks; said center portion of said game board having two rectangles thereon designated for face-down placement of said two decks.

5. The game of claim 4, for at least two and not more than four players.

6. The game of claim 4, said stops illustrated by photographic reproductions of actual such said operations.

7. The game of claim 4, said equipment illustrated by photographic reproductions of actual such said equipment and respective trademarks.

8. The game of claim 4, further comprising:

said stops respectively titled: ROCK CUT, ROCK FILL, DRAINAGE, EARTH CUT, EARTH FILL, GRAVEL, FINE GRADE, PAVING, TOPSOIL, SEED & MULCH, GUARDRAIL, and ROAD STRIPING;

said opportunity steps titled in repeating sequence: LOADER, BIG DOZER, BACKHOE, HAUL TRUCK, MEDIUM DOZER, TEN WHEELER, GRADER, PAVER, SMALL DOZER, HYDROSEEDER, POST HAMMER, and STRIPE TRUCK;

said mandatory steps titled: CALL OFFICE; and said quantity four (4) each of quantity twelve (12) different said equipment tokens titled respectively: LOADER, BIG DOZER, BACKHOE, HAUL TRUCK, MEDIUM DOZER, TEN WHEELER, GRADER, PAVER, SMALL DOZER, HYDROSEEDER, POST HAMMER, and STRIPE TRUCK.

9. The game of claim 8, further comprising a supplemental educational component.

10. The game of claim 1, further comprising a supplemental educational component.

11. A board game for at least two players relating to highway construction, the object of which is to be first to complete a sequence of operations of a highway construction project, said game comprising:

a set of rules describing a method for playing said board game;

a specified amount of play money, an equal portion of which is distributed as initial operating funds to each player at beginning of said game, remainder of which is allocated to a bank with which each player carries out transactions during said game, said bank being a game-related financing and equipment supplier activity administered by a designated one of said players;

a random number selection device for use, in turn, by each said player, said random number selected mandating an action by said player using said selection device, of moving a distinctive play piece selected by said player at beginning of said game;

a game board comprising; a first track having a series of stops representing said sequence of operations of a highway construction project and a second track upon which said play piece is moved based on said random number selected and having a multiplicity of opportunity steps, said opportunity steps of said second track being interdispersed with at least one mandatory step;

a collection of randomly arranged individual supplemental instructions, a next available one of said supplemental instructions which is accessed and executed by each said player when said play piece of said player lands on any said mandatory step, said supplemental instructions being randomly advantageous and disadvantageous for said player;

a distinctive game piece for each said player, said game piece being advanced along said second track in function of said numbers generated by said number selection device and said opportunity steps upon which said play piece lands, each said opportunity step providing an option for said player landing thereon to purchase, from said bank, from a set of equipment tokens a corresponding one of said tokens, each of said tokens representing a piece of specific highway construction equipment necessary to complete a specific said stop of said series of stops on said first track, and each said stop having a monetary draw amount associated with completing said stop, completion of any said stop requiring sequential completion of all preceding stops and current possession of one of said tokens corresponding to said stop, said player upon said completion earning payment of said monetary draw amount from said bank and advancement of said game piece to next said stop;

each of said tokens being resalable, after use, to said bank at a repurchase price less than said purchase price, and each of unused said tokens being transferable for value between said players;

said first track being configured as an inner track around a center portion of said board, said second track configured as an outer track around perimeter of said board.

12. The board game of claim 11, said first track comprising quantity twelve (12) said stops, said second track of said board comprising quantity thirty six (36) said opportunity steps equally interdispersed with quantity four (4) said mandatory steps, said set of said equipment tokens comprising quantity four (4) each of quantity twelve (12) different said equipment tokens.

13. The board game of claim 12, said randomly arranged said collection of supplemental instructions comprising each of said supplemental instructions printed on a face of a card, wherein at least one said supplemental instruction imposes a financial penalty on said player and another at least one said supplemental instruction imposes a financial benefit on said player, said cards being shufflable and divisible into two decks; said center portion of said game board having two rectangles thereon designated for face-down placement of said two decks.

14. The board game of claim 13, further comprising:

said stops respectively titled: ROCK CUT, ROCK FILL, DRAINAGE, EARTH CUT, EARTH FILL, GRAVEL, FINE GRADE, PAVING, TOPSOIL, SEED & MULCH, GUARDRAIL, and ROAD STRIPING;

said opportunity steps titled in repeating sequence: LOADER, BIG DOZER, BACKHOE, HAUL TRUCK, MEDIUM DOZER, TEN WHEELER, GRADER, PAVER, SMALL DOZER, HYDROSEEDER, POST HAMMER, and STRIPE TRUCK;

said mandatory steps titled: CALL OFFICE; and said quantity four (4) each of quantity twelve (12) said equipment tokens titled respectively: LOADER, BIG DOZER, BACKHOE, HAUL TRUCK, MEDIUM DOZER, TEN WHEELER, GRADER, PAVER, SMALL DOZER, HYDROSEEDER, POST HAM- MER, and STRIPE TRUCK.

15. The board game of claim 14, said stops illustrated by photographic reproductions of actual such said operations.

16. The board game of claim 14, said equipment illustrated by photographic reproductions of actual such said equipment and respective trademarks.

17. The board game of claim 14, further comprising a supplemental educational component.

18. A method for playing a game relating to highway construction, the object of which is to be first to complete a sequence of operations of a highway construction project, said method comprising each of said players receiving an equal portion of a specified amount of play money at beginning of said game, remainder of which is allocated to a bank with which each of said players carries out transactions during said game, said bank being a game-related financing and equipment supplier activity administered by a designated one of said players, said players taking sequential turns, each of said turns comprising:

choosing between option to keep and option to sell at auction unused equipment tokens acquired in prior said turns, and executing chosen said option, each of said tokens representing a piece of specific highway construction equipment necessary to complete a specific stop of a series of stops on a first track of a playing surface, said series of stops representing said sequence of operations;

selecting a number by use of a random number selection device;

advancing a distinctive play piece selected by said player at beginning of said game along steps of a second track on said playing surface by amount of said number selected;

choosing between option to buy and option to not buy a corresponding said token from said bank at a designated purchase price when said step to where said play piece has been advanced provides said option to buy, and executing chosen said option;

accessing and executing a next available supplemental instruction from a randomly arranged collection of said supplemental instructions when said play piece has been advanced to a said step which so directs, said supplemental instructions being randomly advantageous and disadvantageous for said player;

advancing a distinctive game piece selected by said player at beginning of said game one stop along said first track of said stops on said playing surface when said player is in possession of a designated said token, and earning payment of monetary draw amount associated with said stop; and choosing between option to sell and option not to sell used said token to said bank at a repurchase price less than said purchase price, and executing chosen said option.

19. The method of claim 18, said first track comprising quantity twelve (12) said stops, said second track comprising quantity thirty six (36) said steps providing said option to buy equally interdispersed with quantity four (4) said steps which direct said accessing and executing of said next available supplemental instruction, said set of said equipment tokens comprising quantity four (4) each of quantity twelve (12) different said equipment tokens.

20. The method of claim 19, said method further comprising a concurrent activity of learning about actual said highway construction by means of a supplemental educational component.

* * * * *